United States Patent [19]

Uchida et al.

[11] Patent Number: 4,863,824

[45] Date of Patent: Sep. 5, 1989

[54] TONER FOR DEVELOPING ELECTROSTATIC LATENT IMAGE

[75] Inventors: Masafumi Uchida; Hiroyuki Takagiwa; Satoru Ikeuchi, all of Hachioji; Hideyo Nishikawa, Wakayama; Shingo Tanaka, Wakayama; Kuniyasu Kawabe, Wakayama, all of Japan

[73] Assignees: Konica Corporation; Kao Corporation, both of Japan

[21] Appl. No.: 165,922

[22] Filed: Mar. 9, 1988

[30] Foreign Application Priority Data

Mar. 14, 1987 [JP] Japan ..... 62-57946

[51] Int. Cl.[4] ..... G03G 9/08

[52] U.S. Cl. ..... 430/109; 430/904

[58] Field of Search ..... 430/109, 904; 524/487, 524/489

[56] References Cited

U.S. PATENT DOCUMENTS

| | | | |
|---|---|---|---|
| 3,965,021 | 6/1976 | Clemens et al. | 430/109 |
| 3,985,664 | 11/1976 | Sakaguchi et al. | 430/109 |
| 4,246,332 | 1/1981 | Tanaka et al. | 430/109 |
| 4,518,673 | 5/1985 | Noguchi et al. | 430/109 X |
| 4,657,837 | 4/1987 | Morita et al. | 430/109 |
| 4,693,952 | 9/1987 | Koizumi et al. | 430/109 |

FOREIGN PATENT DOCUMENTS

| | | | |
|---|---|---|---|
| 56-65146 | 6/1981 | Japan | 430/109 |
| 2100873A | 1/1983 | United Kingdom | 430/109 |

*Primary Examiner*—Paul R. Michl
*Assistant Examiner*—Jeffrey A. Lindeman
*Attorney, Agent, or Firm*—Jordan B. Bierman

[57] ABSTRACT

A toner for developing electrostatic latent images which comprises a colorant and two kinds of polyester is disclosed.

The fFirst polyester is a nonlinear polyester that is composed of monomers including monomers of trivalence or higher valency and which satisfies the following conditions A1 and A2, the second polyester is a nonlinear polyester that is composed of monomers including monomers of trivalence or higher valency and which satisfies the following conditions B1 and B2, and the difference between the softening points of said first and second polyesters is at least 10° C.

condition A1: the monomers of trivalence or higher valency represent from 0.05 mol % to less than 15 mol % of all the monomers present;

condition A2: the softening point is in the range of from 120° C. to 160° C.;

condition B1: the monomers of trivalence or higher valency represent from 0.05 mol % to less than 15 mol % of all the monomers represent;

condition B2: the softening point is in the range of from 80° C. to less than 120° C.

9 Claims, No Drawings

TONER FOR DEVELOPING ELECTROSTATIC LATENT IMAGE

BACKGROUND OF THE INVENTION

The present invention relates to a toner for use in development of electrostatic latent image formed in such processes as electrophotography, electrostatic printing and electrostatic recording.

To take electrophotography as an example of the processes in which the toner of the present invention is to be employed, a electrostatic latent image is formed on a photoconductive photoreceptor through charging and exposure steps and the so formed electrostatic latent image is developed with colored toner particles, with the resulting toner image being subsequently transferred onto an image receiving sheet and fixed with heat or under pressure so as to form a visible image.

A variety of methods have been employed to fix the toner image and the use of hot roll is particularly preferred. In this method, an image-receiving sheet such as paper that carries the toner image is transported in contact with hot roll so as to fix the toner image onto the paper. This fixing method is advantageous not only from the viewpoint of safety but also in terms of energy saving due to reduced heat loss. However, in order to fix the toner image by passage through hot roll, the molten toner particles have to be brought into contact with the surface of the roll and this is prone to cause an undesired phenomenon called "hot offsetting" in which part of the fused toner particles are transferred onto the surface of the roll and thereafter picked up by the image-receiving sheet being fed in the next cycle of process, resulting in a soiled image.

The demand for increasing the operating speed of copying machines or reducing their size is growing today and it is strongly desired to develop a toner the image of which can be fixed at temperatures lower than those which have been feasible in the prior art. If a number of copying cycles are run on a high-speed copier, a substantial amount of the heat generated by the hot rollers is lost to the image-receiving sheet and the supply of heat becomes insufficient to prevent frequent occurrence of poor fixing of the toner image due to the decrease in the temperature of the roll. In small-size copiers, the capacity of the heater for heating the roll must be reduced to realize energy saving and compactness. However, heaters of a smaller capacity require undesirably long time to heat the roll or are unable to supply the necessary heat for enabling continuous copying, which again results in frequent occurrence of poor fixing of the toner image due to the decrease in the temperature of the roll.

Therefore, toners suitable for use in electrophotography must satisfy the following two basic requirements: (1) higher resistance to "hot offsetting"; and (2) effective fixing of the toner image at low temperatures.

The following two techniques have been proposed in an attempt to enable the fixing of toner image at lower temperatures without sacrificing the resistance to hot offsetting:

(1) using as a toner resin a nonlinear polyester that consists of monomers including monomers of trivalence or higher valency and in which the content of such monomers of trivalence or higher valency in all the monomers present is held low and with a carboxylic acid having an alkenyl or alkyl group being introduced in side chains (see Unexamined Published Japanese Patent Application No. 109825/1982, Japanese Patent Application No. 109539/1984 and Unexamined Published Japanese Patent Application No. 7960/1984); and (2) using as a toner resin a nonlinear polyester that consists of monomers including monomers of trivalence or high valency and in which the content of such monomers of trivalence or higher valency in all the monomers present is held low and with a long-chain aliphatic hydrocarbon group being introduced in the backbone chain (see Japanese Patent Application Nos. 216244/1985 and 217995/1985).

These conventional methods, however, have the disadvantage that when the mixture of starting materials for toner is ground into particles at ambient temperature, the particles have a tendency to form clump matters and subsequent grinding operations cannot be smoothly effected to produce toner particles of a desired size, leading to a lower production rate and a higher cost.

To facilitate the grinding operation, the molecular weight of the toner resin may be lowered tut this could result in a toner that is low in resistance to hot offsetting. An ideal toner should have a good anti-blocking property, namely, it should remain in a stable powder form without agglomerating under use or storage conditions. However, if the molecular weight of a toner resin is lowered, its glass transition point will also decrease to such an extent that the resulting toner particles have a great tendency to agglomerate (i.e., become poor in anti-blocking property).

SUMMARY OF THE INVENTION

The present invention has been accomplished in order to solve the aforementioned problems of the prior art. An object, therefore, of the present invention is to provide a toner for developing electrostatic latent images that satisfies the following four requirements for an ideal toner; (1) high resistance to hot offsetting; (2) ease of toner image fixing at low temperatures; (3) sufficiently good grindability to enable the employment of standard grinding techniques to produce a toner; and (4) high resistance to blocking.

This object of the present invention can be attained by a toner for developing electrostatic latent images that a colorant and two kinds of polyester, the first polyester being a nonlinear polyester that is composed of monomers including monomers of trivalence or higher valency and which satisfies the following conditions A1 and A2, the second polyester being a nonlinear polyester that is composed of monomers including monomers of trivalence or higher valency and which satisfies the following conditions B1 and B2, and the difference between the softening points of said first and second polyesters being at least 10° C.:

condition A1: the monomers of trivalence or higher valency represent from 0.05 mol % to less than 15 mol % of all the monomers present;

condition A2: the softening point is in the range of from 120° C. to 160° C.;

condition B1: the monomers of trivalence or higher valency represent from 0.05 mol % to less than 15 mol % of all the monomers present;

condition B2: the softening point is in the range of from 80° C. to less than 120° C.

DETAILED DESCRIPTION OF THE INVENTION

The toner of the present invention comprises two different types of polyesters having the characteristics described above, which combine synergistically to achieve the intended properties, i.e., high resistance to hot offsetting, ease of fixing toner image at low temperatures, good grindability, and high resistance to blocking.

The first polyester used in the toner composition of the present invention is a nonlinear polyester that is low in the content of monomers of trivalence or higher valency and which has a relatively high molecular weight. Because of these characteristics, the first polyester exhibits by itself high resistance to hot offsetting and ease of toner image fixing at low temperatures and good anti-blocking property as well. On the other hand, the grindability of this polyester is poor. The second polyester is a nonlinear polyester that is low in the content of monomers of trivalence or higher valency but which has a relatively low molecular weight. Because of these characteristics, the second polyester ensures ease of toner image fixing at low temperatures and good grindability by itself. On the other hand, this second polyester is poor in resistance to hot offsetting and blocking. Therefore, if these two polyesters are used independently from each other, their own defects will appear dramatically in the final product. However, in the toner composition of the present invention, these polyesters are incorporated in combination to give an apparently broadened distribution of molecular weight. As a result, the first polyester having the higher molecular weight contributes improved resistance to hot offsetting, ease of toner image fixing at low temperatures, and good antiblocking property, whereas the second polyester having the lower molecular weight imparts good grindability and ease of toner image fixing at low temperatures. As an overall effect, the combination of the first and second polyesters ensures significant improvements in grindability and ease of toner image fixing at low temperatures without sacrificing the resistance to hot off-setting or blocking, and a toner with improved characteristics can be efficiently produced by a process involving standard grinding techniques.

The toner for developing electrostatic latent image of the present invention contains as the essential components the first polyester and the second polyester, whose softening points (Tsp) differ from each other by a degree of at least 10° C.

The first polyester is a nonlinear polyester that is composed of monomers including monomers of trivalence or high valency and which satisfies the already-specified conditions A1 and A2.

The second polyester is a nonlinear polyester that is composed of monomers including monomers of trivalence or higher valency and which satisfies the conditions B1 and B2.

If the content of the monomers of trivalence or higher valency in each of the first and second polyesters is equal to or more than 15 mol % of all of the monomers present, the fixability of toner image is reduced. If the content of such monomers is less than 0.05 mol % of all of the monomers present in the polyester, the resulting toner composition will have an undesirably low level of resistance to hot offsetting.

If the softening point (Tsp) of the first polyester is higher than 160° C., the fixability of toner image and grindability will be reduced. If the softening point of this polyester is less than 120° C., the resulting toner composition will not have high resistance to hot-offsetting.

If the softening point (Tsp) of the second polyester is equal to or higher than 120° C., the grindability of the mix of starting materials is impaired. If the softening point of this polyester is less than 80° C., the resulting toner composition will have reduced resistance to hot offsetting.

If the difference between the softening points of the first and second polyesters is less than 10° C., the desired characteristics of the respective polyesters will not be fully exhibited and the resulting toner composition will be unsatisfactory in either one of the following properties, i.e., resistance to hot offsetting, fixability of toner image at low temperatures, grindability and anti-blocking property.

The first polyester preferably contains chloroform insolubles in amounts of from 0 to 25 wt %. The second polyester preferably contains chloroform insolubles in amounts of from 0 to less than 5 wt %. If the content of chloroform insolubles in the first polyester exceeds 25 wt %, the fixability of toner image at low temperatures may sometimes be impaired. If the content of chloroform insolubles in the second polyester is 5 wt % or more, the grindability of the mix of starting materials may sometimes be decreased.

The weight ratio of the first to second polyester in the toner of the present invention is preferably in the range of from 90:10 to 30:70, more preferably from 80:20 to 40:60. If the proportion of the first polyester is excessive, the grindability of the mix of starting materials tends to be impaired. If the proportion of the first polyester is too small, the resulting toner has a tendency to become poor in resistance to hot offsetting and blocking.

In a preferred embodiment, each of the first and second polyesters is composed of monomers containing a diol component represented by the following general formula (1):

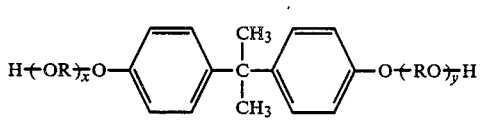

(1)

where R is an ethylene or propylene group; x and y are each an integer, with the average of the sum of x and y being 2 to 7.

If such a diol component is contained as a structural unit, the resulting toner composition will have even better properties in terms of resistance to hot offsetting, fixability of toner image at low temperatures and resistance to blocking.

The first polyester preferably has a glass transition point (Tg) in the range of 45°–85° C. By selecting a compound having a glass transition point in this range, a toner composition featuring further improvements in the fixability of toner image at low temperatures and in the antiblocking property can be attained. If the glass transition point of the first polyester exceeds 85° C., the fixability of toner image at low temperatures may sometimes be impaired. If the glass transition point of the first polyester is less than 45° C., the resulting toner may sometimes have reduced resistance to blocking.

The second polyester preferably has a glass transition point (Tg) in the range of 40°–80° C. By selecting a compound having a glass transition point in this range, a toner composition characterized by further improvements in the fixability of toner image at low temperatures and in the antiblocking property can be attained. If the glass transition point of the second polyester exceeds 80° C., the fixability of toner image at low temperatures may sometimes be impaired. If the glass transition point of the second polyester is less than 40° C., the resulting toner may sometimes have reduced resistance to blocking.

Basically, the following monomers (a) and (b) can be employed to synthesize the first and second polyesters for incorporation in the toner composition of the present invention. Other monomers may of course be used as required:

(a) a divalent alcohol monomer and a divalent carboxylic acid monomer, which serves as the constituent of the main chain (i.e. basic backbone of the polyester;

(b) a trivalent or higher valent alcohol monomer and/or a trivalent or higher valent carboxylic acid monomer, which renders the polyester nonlinear, or branched or in a network structure.

Examples of the divalent alcohol monomer as (a) include: etherified bisphenol, ethylene glycol, diethylene glycol, triethylene glycol, 1,2-propylene glycol, 1,3-propylene glycol, 1,4-butanediol, neopentyl glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

Among these examples, etherified bisphenol isparticularly preferred and illustrated by, for example, polyoxypropylene (2,2)-2,2-bis(4-hydroxyphenyl)propane, polyoxypropylene(3,3)-2,2-bis(4-hydroxyphenyl)propane, polyoxyethylene(2.0)-2,2-bis-(4-hydroxyphenyl)propane, polyoxypropylene(2.0)-polyoxyethylene(2.0)-2,2-bis(4-hydroxyphenyl)propane, and polyoxypropylene-(6)-2,2-bis(4-hydroxyphenyl)propane.

Examples of the divalent carboxylic acid monomer as (a) include: maleic acid, fumaric acid, citraconic acid, itaconic acid, glutaconic acid, phthalic acid, isophthalic acid, terephthalic acid, succinic acid, adipic acid, sebacic acid, azelaic acid, maloic acid, n-dodecenylsuccinic acid, isododecenylsuccinic acid, n-dodecylsuccinic acid, isododecylsuccinic acid, n-octenylsuccinic acid, n-octylsuccinic acid, as well as anhydrides and loweralkyl esters thereof.

Examples of the trivalent or higher valent alcohol monomer as (b) include: sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of the trivalent or higher valent carboxylic acid monomer as (b) include: 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, trimer acids (Empol), as well as anhydrides and loweralkyl esters of these acids.

In the synthesis of the first and second polyesters, a long-chain aliphatic hydrocarbon unit is preferably introduced in the main chain and/or side chains of the polyester by using a divalent or higher valent alcohol monomer having said long-chain aliphatic hydrocarbon unit or a divalent or higher valent carboxylic acid monomer having said long chain aliphatic hydrocarbon unit. The term "long chain" in the long-chain aliphatic hydrocarbon unit means a straight chain containing at least 3, preferably 3–30, carbon atoms. In order to ensure ease of fixing a toner image at low temperatures, a long chain containing 5–22 carbon atoms is particularly preferred. The divalent or higher valent alcohol monomer or carboxylic acid monomer having the long chain aliphatic hydrocarbon unit in the main chain is preferably used in such an amount that said long-chain aliphatic hydrocarbon unit is present in the main chain of the nonlinear polyester in an amount of 1–60 mol %, preferably 5–50 mol %, of the structural units of said main chain. The divalent or higher valent alcohol or carboxylic acid monomer having the long-chain aliphatic hydrocarbon unit in side chains is preferably used in an amount of 1–50 mol % of all the monomers used, with the range of 10–30 mol % being particularly preferred.

In synthesizing the first and second polyesters, monomers that are capable of introducing an unsaturated aliphatic hydrocarbon unit into the main chain of the polyester may also be employed.

The softening point, Tsp, and the glass transition point, Tg, are defined as the values that are measured by the following methods:

Softening point, Tsp

Using a flow tester "CFT-500" (Shimazu Corporation), a sample in a volume of 1 $cm^3$ is melted to flow through a die orifice (1 mmϕ) at a pressure of 20 $kg/cm^2$ with the temperature being increased at a rate of 6° C./min. The temperature which is half the height from the flow start point to the flow end point as in a flow curve is defined as the softening point, Tsp, of the sample.

Glass transition point, Tg

Using a differential scanning calorimeter (Seiko Denshi Kogyo K.K.), a sample is heated to 100° C., held at that temperature for 3 minutes and thereafter cooled to room temperature at a rate of 10° C./min. The sample is then heated at a rate of 10° C./min and the temperature at the point where an extension of the baseline below the glass transition point intersects the steepest tangent line between the rising point of the peak and the top of the peak is defined as the glass transition point, Tg, of the sample.

In the present invention, the term "chloroform insolubles" means that part of a sample solution in chloroform which is retained on filter paper and their content is determined as follows:

Finely divided sample is passed through a 40 mesh sieve, and 5.00 g of the resulting powder is put in a 150-ml container together with 5.00 g of a filter aid (Radiolite #700). Chloroform (100 g) is poured into the container, which is rotated on a ball mill table for a period of 5 hours or longer until the sample is thoroughly dissolved in the chloroform. A filter disc (No. 2, 7 cm in dia.) is placed in a pressure filter, and after it is precoated with a uniform layer of Radiolite (5.00 g), a small volume of chloroform is added to bring the filter paper into intimate contact with the filter, and thereafter, the contents of the container are poured into the filter. The container is washed thoroughly with 100 ml of chloroform and the residual contents are emptied into the filter so that nothing is left on the container wall. Then, the filter cap is closed and filtration is performed at a pressure of not more than 4 kg/cm$^2$. When no more chloroform flows out, 100 ml of additional chloroform is supplied to wash off the residue from the filter paper, and another cycle of pressure filtration is started. After these procedures, the filter paper, as well as the residue and Radiolite on it are put on an aluminum foil which is transferred to a vacuum dryer where it is dried at 80°-100° C. and 100 mmHg for 10 hours. The total weight a (g) of the resulting solid is measured and the content of the chloroform insolubles x (wt %) is calculated by the following formula:

$$x(\text{wt }\%) = \frac{a\,(\text{g}) - \text{weight of the filter paper (g)} - \text{weight of Radiolite (10.00 g)}}{\text{weight of the sample (5.00 g)}} \times 100$$

The chloroform insolubles whose content is determined by the above procedure are present as a high-molecular weight or crosslinked polymeric component in the polyester.

The toner of the present invention contains the above-described first and second polyesters as the essential components. Besides these components, the toner may contain a colorant and any other optional additives. Other resins may of course be contained in the toner, as required.

It is particularly preferred to use low-molecular weight polyolefins as optional additives other than colorants. More specifically, low-molecular weight polyethylene and polypropylene may be used with advantage. Particularly preferred low-molecular weight polyolefins are those which have softening points in the range of 70°-150° C., notably between 120° and 150° C., as measured by the ball-and-ring test method specified in JIS 2531-1960. By incorporating such low-molecular weight polyolefins, further improvements can be attained with respect to grindability and resistance to hot offsetting.

Illustrative colorants include carbon black, nigrosine dye (C.I. No. 50415B), aniline blue (C.I. No. 50405), chalcooil blue (C.I. No. azoic Blue 3), chrome yellow (C.I. No. 14090), ultramarine blue (C.I. No. 77103), Du Pont oil red (C.I. No. 26105), quinoline yellow (C.I. No. 47005), methylene blue chloride (C.I. No. 52015), phthalocyanine blue (C.I. No. 74160), malachite green oxalate (C.I. No. 42000), lamp black (C.I. No. 77266) and Rose Bengale (C.I. No. 45435), and mixtures thereof. These colorants are usually incorporated by weight of the toner.

If a magnetic toner is desired, a magnetic material is incorporated in the toner composition of the present invention. Illustrative magnetic materials include ferrite, magnetite and other compounds containing ferromagnetic metals such as iron, cobalt and nickel and alloys thereof, as well as alloys that do not contain a ferromagnetic element but which exhibit ferromagnetism if they are given a suitable heat treatment, such as Heusler alloys including manganese and copper (e.g., Mn-Cu-Al and Mn-Cu-Sn), and chromium dioxide, etc. These magnetic materials are dispersed uniformly in the toner in the form of fine particles having an average size between 0.1 and 1 micron, and they are contained in an amount of from 20 to 70 parts by weight, preferably from 25 to 50 parts by weight, per 100 parts by weight of the toner.

The toner of the present invention may be produced by the following method: the two essential components, i.e., the first and second polyesters, and optionally, other resins as well as colorants and any other appropriate additives are subjected to preliminary blending, and the blend is kneaded in a molten state, cooled, ground into particles, first coarsely, then finely, and finally classified to a desired particle size.

The toner of the present invention may be combined with a carrier to formulate a two-component developer. Alternatively, a magnetic material may be incorporated in the toner composition to formulate a one-component developer.

The following examples are provided for the purpose of further illustrating the present invention but are in no way to be taken as limiting.

Preparation of Polyesters

Starting materials the recipes of which are shown in Table 1 were charged into a four-necked flask (capacity, 2 l) equipped with a thermometer, a stainless steel stirrer, a nitrogen introducing glass pipe and a dropping condenser. The flask was set in a mantle heater and reaction was carried out with stirring at 200° C. in a nitrogen atmosphere. The progress of the reaction was monitored by an acid value measurement. At the time when a predetermined acid value was attained, the reaction was quenched and the reaction product was cooled to room temperature to yield polyester samples in the form of a pale yellow solid.

The characteristic values of the polyester samples are noted in Table 2.

TABLE 1

| | Alcohol component | | | Acid component | | | | |
|---|---|---|---|---|---|---|---|---|
| Polyester No. | polyoxypropylene (2.2)-2,2-bis (4-hydroxyphenyl) propane | polyoxyethylene (2.0)-2,2-bis (4-hydroxyphenyl) propane | trimethylol-propane | succinic acid | terephthalic acid | isododecenyl succinic acid | adipic acid | 1,2,4-benzene-tricarboxylic anhydride |
| 1-1 | 700 g(2.03 mol) | — | — | 236 g (2.00 mol) | — | — | — | 3.8 g(0.02 mol) |
| 1-2a | 700 g(2.03 mol) | — | — | 203 g (1.72 mol) | — | — | — | 36.5 g(0.19 mol) |
| 1-2b | 700 g(2.03 mol) | — | — | 203 g (1.72 mol) | — | — | — | 36.5 g(0.19 mol) |
| 1-2c | 700 g(2.03 mol) | — | — | 203 g (1.72 mol) | — | — | — | 36.5 g(0.19 mol) |
| 1-2d | 700 g(2.03 mol) | — | — | 203 g (1.72 mol) | — | — | — | 36.5 g(0.19 mol) |
| 1-2e | 700 g(2.03 mol) | — | — | 203 g (1.72 mol) | — | — | — | 36.5 g(0.19 mol) |

TABLE 1-continued

| Polyester No. | Alcohol component: polyoxypropylene (2.2)-2,2-bis (4-hydroxyphenyl) propane | polyoxyethylene (2.0)-2,2-bis (4-hydroxyphenyl) propane | trimethylol-propane | Acid component: succinic acid | terephthalic acid | isododecenyl succinic acid | adipic acid | 1,2,4-benzene-tricarboxylic anhydride |
|---|---|---|---|---|---|---|---|---|
| 1-3 | 700 g(2.03 mol) | — | — | 151 g (1.28 mol) | — | — | — | 96.0 g(0.50 mol) |
| 1-4a | 700 g(2.03 mol) | — | — | 240 g (2.03 mol) | — | — | — | — |
| 1-4b | 700 g(2.03 mol) | — | — | 240 g (2.03 mol) | — | — | — | — |
| 1-5a | 700 g(2.03 mol) | — | — | 126 g (1.07 mol) | — | — | — | 123 g(0.64 mol) |
| 1-5b | 700 g(2.03 mol) | — | — | 126 g (1.07 mol) | — | — | — | 123 g(0.64 mol) |
| 2-1 | 691 g(2.01 mol) | — | 2.7 g (0.02 mol) | — | 232 g (1.40 mol) | 172 g(0.65 mol) | — | — |
| 2-2a | 602 g(1.75 mol) | — | 25.0 g (0.19 mol) | — | 232 g (1.40 mol) | 172 g(0.65 mol) | — | — |
| 2-2b | 602 g(1.75 mol) | — | 25.0 g (0.19 mol) | — | 232 g (1.40 mol) | 172 g(0.65 mol) | — | — |
| 2-2c | 602 g(1.75 mol) | — | 25.0 g (0.19 mol) | — | 232g (1.40 mol) | 172 g(0.65 mol) | — | — |
| 2-2d | 602 g(1.75 mol) | — | 25.0g (0.19 mol) | — | 232g (1.40 mol) | 172 g(0.65 mol) | — | — |
| 2-3 | 447 g(1.30 mol) | — | 67.0 g (0.50 mol) | — | 232 g (1.40 mol) | 172 g(0.65 mol) | — | — |
| 3-1a | 350 g(1.02 mol) | 325 g(1.03 mol) | — | — | — | — | 251 g (1.63 mol) | 36.0 g(0.19 mol) |
| 3-1b | 350 g(1.02 mol) | 325 g(1.03 mol) | — | — | — | — | 251 g (1.63 mol) | 36.0 g(0.19 mol) |
| 3-1c | 350 g(1.02 mol) | 325 g(1.03 mol) | — | — | — | — | 251 g (1.63 mol) | 36.0 g(0.19 mol) |

TABLE 2

| Polyester No. | Proportion of trivalent or higher valent monomer in all the monomers present (mol %) | Tsp (°C.) | Tg (°C.) | chloroform insolubles (wt %) |
|---|---|---|---|---|
| 1-1 | 0.5 | 130 | 65 | 0 |
| 1-2a | 4.8 | 83 | 48 | 0 |
| 1-2b | 4.8 | 95 | 62 | 0 |
| 1-2c | 4.8 | 118 | 64 | 0 |
| 1-2d | 4.8 | 130 | 66 | 6.2 |
| 1-2e | 4.8 | 162 | 68 | 34.5 |
| 1-3 | 13.1 | 130 | 68 | 8.2 |
| 1-4a | 0 | 100 | 60 | 0 |
| 1-4b | 0 | 130 | 64 | 0 |
| 1-5a | 17.1 | 100 | 63 | 0 |
| 1-5b | 17.1 | 130 | 70 | 10.0 |
| 2-1 | 0.5 | 100 | 57 | 0 |
| 2-2a | 4.8 | 100 | 58 | 0 |
| 2-2b | 4.8 | 122 | 64 | 0 |
| 2-2c | 4.8 | 140 | 67 | 12.4 |
| 2-2d | 4.8 | 158 | 69 | 32.5 |
| 2-3 | 13.1 | 100 | 60 | 0 |
| 3-1a | 4.9 | 78 | 40 | 0 |
| 3-1b | 4.9 | 122 | 58 | 5.4 |
| 3-1c | 4.9 | 140 | 62 | 20.3 |

EXAMPLES AND COMPARATIVE EXAMPLES

In the examples and comparative examples, 100 parts by weight of polyester combinations (for the names and proportions of individual components, see Table 3), 10 parts by weight of carbon black "Mogul L" (product of Cabot Corporation) and 5 parts by weight of a low-molecular weight polypropylene "Biscol 660P" (Tsp, 130° C.; product of Sangyo Chemical Industries, Ltd.) were preliminarily blended and subjected to a standard process consisting of melting, kneading, cooling, grinding and classification. As a result, toners having an average particle size of 10 μm were obtained.

In the grinding step, the clump matters formed by kneading were screened through a sieve system including 9.2 mesh and 16 mesh screens having nominal sizes of 2 mm and 1 mm, respectively. The particles that passed through the 9.2 mesh screen but did not pass through the 16 mesh screen were finely ground with a jet-type mill.

Assessments (1) Grindability

The grindability of the toner samples was evaluated in terms of the average size of the particles obtained in the grinding step when the grinding speed was adjusted to 100 g/min. The following criteria were used in assessment: o, less than 10 μm in average diameter; x, 10 μm or more.

(2) Minimum fixing temperature

A hot roll fusing apparatus was constructed by combining a hot roll having a surface coating of Teflon (polytetrafluoroethylene of Du Pont) and a backup roller made of the core of a silicone rubber "KE-1300RTV" (Shinetsu Chemical Industries Co., Ltd.) with a Teflon sleeve on. Toner image formed with each sample was transferred onto a receiving sheet (64 g/m$^2$ at a temperature of 10° C. and a relative humidity of 20%, and fixed in the test apparatus at a linear speed of 200 mm/sec, with the temperature of the hot roll being decreased stepwise from 250° C.

The samples carrying fixed image were abraded by the Kim wipe method and the lowest temperature of the hot roll that produced a fixed image showing adequate resistance to abrasion was used as the index of "minimum fixing temperature". The hot roll fusing apparatus employed did not have any mechanism for supplying silicone oil.

(3) Hot offsetting temperature

In accordance with the method for measurement of the minimum fixing temperature, toner image was transferred and fixed with the hot roll fusing apparatus. A white receiving sheet was subsequently passed through the same fusing apparatus under the same conditions, and visual checking was made to see if the sheet was soiled by toner particles with the temperature of the hot roll being decreased stepwise. The lowest temperature of the hot roll that caused soiling by toner particles was used as the index of "hot offsetting temperature".

The results of the three assessments are summarized in Table 3.

Toner sample Nos. 1–9 were left for 2 hours at 55° C. and at a relative humidity of 26% and their anti-blocking property was evaluated by checking for the agglomeration of toner particles into clumps. None of the samples of the present invention tested formed clumps of toner particles, indicating their high resistance to blocking.

TABLE 3

| | Toner sample No. | First polyester | | | | Second polyester | | | | Grindability | | Hot offsetting temperature (°C.) | Minimum fixing temperature (°C.) |
|---|---|---|---|---|---|---|---|---|---|---|---|---|---|
| | | No. | Proportion of trivalent or higher valent monomer in all the monomers present (mol %) | Tsp (°C.) | Content (parts by wt) | No. | Proportion of trivalent or higher valent monomer in all the monomers present (mol %) | Tsp (°C.) | Content (parts by wt) | average particle size (μm) | rating | | |
| Examples | | | | | | | | | | | | | |
| 1 | toner 1 | 1-1 | 0.5 | 130 | 70 | 1-2b | 4.8 | 95 | 30 | 7.2 | O | ≧250 | 150 |
| 2 | toner 2 | 1-2d | 4.8 | 130 | 70 | 1-2b | 4.8 | 95 | 30 | 6.7 | O | ≧250 | 155 |
| 3 | toner 3 | 1-3 | 13.1 | 130 | 70 | 1-2b | 4.8 | 95 | 30 | 5.3 | O | ≧250 | 160 |
| 4 | toner 4 | 2-2c | 4.8 | 140 | 60 | 2-1 | 0.5 | 100 | 40 | 6.8 | O | ≧250 | 145 |
| 5 | toner 5 | 2-2c | 4.8 | 140 | 60 | 2-3 | 13.1 | 100 | 40 | 5.2 | O | ≧250 | 155 |
| 6 | toner 6 | 2-2b | 4.8 | 122 | 80 | 2-2a | 4.8 | 100 | 20 | 4.9 | O | ≧250 | 150 |
| 7 | toner 7 | 2-2d | 4.8 | 158 | 80 | 2-2a | 4.8 | 100 | 20 | 7.4 | O | ≧250 | 160 |
| 8 | toner 8 | 3-1c | 4.9 | 140 | 40 | 1-2a | 4.8 | 83 | 60 | 4.7 | O | ≧250 | 140 |
| 9 | toner 9 | 3-1c | 4.9 | 140 | 40 | 1-2c | 4.8 | 118 | 60 | 5.1 | O | ≧250 | 155 |
| Comparative Examples | comparative | | | | | | | | | | | | |
| 1 | toner 1 | 1-4b | 0 | 130 | 70 | 1-2b | 4.8 | 95 | 30 | 15.2 | X | 220 | 150 |
| 2 | comparative toner 2 | 1-5b | 17.1 | 130 | 70 | 1-2b | 4.8 | 95 | 30 | 5.4 | O | ≧250 | 200 |
| 3 | comparative toner 3 | 1-2d | 4.8 | 130 | 70 | 1-4a | 0 | 100 | 30 | 12.5 | X | 180 | 155 |
| 4 | comparative toner 4 | 1-2d | 4.8 | 130 | 70 | 1-5a | 17.1 | 100 | 30 | 6.8 | O | ≧250 | 190 |
| 5 | comparative toner 5 | 1-2c | 4.8 | 118 | 80 | 2-2a | 4.8 | 100 | 20 | 4.4 | O | 210 | 150 |
| 6 | comparative toner 6 | 1-2e | 4.8 | 162 | 80 | 2-2a | 4.8 | 100 | 20 | 10.3 | X | ≧250 | 185 |
| 7 | comparative toner 7 | 2-2c | 4.8 | 140 | 40 | 3-1a | 4.9 | 78 | 60 | 4.6 | O | 190 | 140 |
| 8 | comparative toner 8 | 2-2c | 4.8 | 140 | 40 | 3-1b | 4.9 | 122 | 60 | 10.1 | X | ≧250 | 180 |
| 9 | comparative toner 9 | 2-2c | 4.8 | 140 | 100 | — | — | — | — | 18.1 | X | ≧250 | 220 |
| 10 | comparative toner 10 | — | — | — | — | 2-2a | 4.8 | 100 | 100 | 3.4 | O | 120 | 110 |

As the above results show, toner sample Nos. 1–9 prepared in accordance with the present invention satisfied all the requirements for high resistance to hot offsetting, ease of fixing toner image at low temperatures, good grindability and high resistance to blocking. Therefore, toners having good characteristics can be produced efficiently by employing conventional grinding techniques.

Comparative toner sample No. 1 was poor in grindability and resistance to hot offsetting because the first polyester was prepared without using any trivalent or higher valent monomer.

Comparative toner sample No. 2 was poor with respect to toner image fixing at low temperatures because excessive amounts of trivalent or higher valent monomers were used in the preparation of the first polyester.

Comparative toner sample No. 3 was also poor in grindability and resistance to hot offsetting because the second polyester was prepared without using any trivalent or higher valent monomer.

Comparative toner sample No. 4 was poor with respect to toner image fixing at low temperatures because excessive amounts of trivalent or higher valent monomers were used in preparing the second polyester.

Comparative toner sample No. 5 did not have high resistance to hot offsetting because the softening point, Tsp, of the first polyester was unduly low.

Comparative toner sample No. 6 was poor in grindability and did not allow for toner image fixing at low temperatures since the softening point, Tsp, of the first polyester was unduly high.

Comparative toner sample No. 7 did not have high resistance to hot offsetting because the softening point, Tsp, of the second polyester was unduly low.

Comparative toner sample No. 8 was also poor in grindability and did not allow for toner image fixing at low temperatures since the softening point, Tsp, of the second polyester was unduly high.

Comparative toner sample No. 9 was poor in grindability and did not allow for toner image fixing at low temperatures since it did not contain the second polyester.

Comparative toner sample No. 10 did not have high resistance to hot offsetting since it did not contain the first polyester.

What is claimed is:

1. A toner for developing electrostatic latent images comprising a colorant and two kinds of polyester, the first polyester being a nonlinear polyester compound of monomers including monomers of at least trivalence and which satisfies conditions A1 and A2, the second polyester being a nonlinear polyester composed of monomers including monomers of at least trivalence and which satisfies conditions B1 and B2, the difference between the softening points of said first and second polyesters being at least 10° C.:

condition A1: the monomers of trivalence or higher valency represent from 0.05 mol % to less than 15 mol % of all the monomers present;

condition A2: the softening point is in the range of from 20° to 60° C.;

condition B1: the monomers of trivalence or higher valency represent from 0.05 mol % to less than 15 mol % of all the monomers present;

condition B2: the softening point is in the range of from 80° C. to less than 120° C.;

each of said first and second polyesters comprising monomers containing a diol component represented by the following general formula (1):

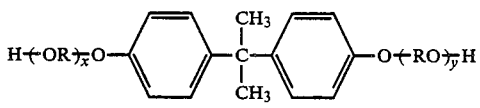

(1)

wherein R is an ethylene or propylene group; and x and y are each an integer, with the average of the sum x and y being 2 to 7.

2. A toner according to claim 1 wherein said first and second polyesters are incorporated at a weight ratio ranging from 90:10 to 30:70, preferably from 80:20 to 40:60.

3. A toner according to claim 1 wherein the first polyester has a glass transition point of 45° to 85° C. and the second polyester has a glass transition point of 40° to 80° C.

4. A toner according to claim 2 wherein the first polyester has a glass transition point of 45° to 85° C. and the second polyester has a glass transition point of 40° to 80° C.

5. A toner according to claim 4 wherein the first polyester contains chloroform insolubles in amounts of from 0 to 25 wt % and the second polyester contains chloroform insolubles in amounts of from 0 to less than 5 wt %.

6. A toner according to claim 1 which further contains a low-molecular weight polyolefin.

7. A toner according to claim 5 which further contains a low-molecular weight polyolefin.

8. A toner according to claim 1 which further comprises a magnetic material.

9. A toner according to claim 5 which further comprises a magnetic material.

* * * * *